United States Patent [19]

Hashish et al.

[11] Patent Number: 4,648,215

[45] Date of Patent: Mar. 10, 1987

[54] METHOD AND APPARATUS FOR FORMING A HIGH VELOCITY LIQUID ABRASIVE JET

[75] Inventors: Mohamed A. Hashish, Kent; Michael J. Kirby, Vashon; Yih-Ho Pao, Bellevue, all of Wash.

[73] Assignee: Flow Industries, Inc., Kent, Wash.

[21] Appl. No.: 786,136

[22] Filed: Oct. 7, 1985

Related U.S. Application Data

[63] Continuation of Ser. No. 701,460, Feb. 14, 1985, abandoned, which is a continuation of Ser. No. 436,002, Oct. 22, 1982, abandoned.

[51] Int. Cl.[4] ..... B24C 5/04

[52] U.S. Cl. ..... 51/439; 51/321

[58] Field of Search ..... 51/439, 319, 320, 321; 83/53, 177; 239/1, 597, 601

[56] References Cited

U.S. PATENT DOCUMENTS

| | | | |
|---|---|---|---|
| 2,176,577 | 10/1939 | Tirrell | 51/321 |
| 2,376,287 | 5/1945 | Sorrentino | 51/439 |
| 2,985,050 | 5/1961 | Schwacha | 83/177 |
| 3,756,106 | 9/1973 | Chadwick et al. | 83/177 |
| 3,994,097 | 11/1976 | Lamb | 51/321 |
| 4,216,906 | 8/1980 | Olsen et al. | 83/177 |
| 4,218,855 | 8/1980 | Wemmer | 51/439 |

FOREIGN PATENT DOCUMENTS

| | | | |
|---|---|---|---|
| 223875 | 1/1960 | Australia . | |
| 229707 | 8/1960 | Australia . | |
| 0484524 | 7/1952 | Canada | 51/439 |
| 0069875 | 1/1983 | European Pat. Off. . | |
| 0090691 | 10/1983 | European Pat. Off. . | |
| 0480070 | 3/1930 | Fed. Rep. of Germany . | |
| 1477991 | 7/1969 | Fed. Rep. of Germany . | |
| 2724318 | 11/1978 | Fed. Rep. of Germany . | |
| 2928698 | 2/1981 | Fed. Rep. of Germany . | |
| 1203550 | 1/1960 | France . | |
| 2348751 | 11/1977 | France . | |
| 2369008 | 5/1978 | France . | |

*Primary Examiner*—Frederick R. Schmidt
*Assistant Examiner*—Robert A. Rose
*Attorney, Agent, or Firm*—Flehr, Hohbach, Test, Albritton & Herbert

[57] ABSTRACT

A method and apparatus for producing a coherent stream of high velocity abrasive laden liquid. The method includes allowing the particles to assume the direction and velocity of a high velocity jet of liquid. This method also allows concentration of particles in the center of the flow of liquid to reduce nozzle wear and increase cutting efficiency. The apparatus includes a nozzle having a converging section attached to a straight section that is sufficiently large that the abrasive particles approach the velocity of the fluid jet before exit of the nozzle.

24 Claims, 6 Drawing Figures

METHOD AND APPARATUS FOR FORMING A HIGH VELOCITY LIQUID ABRASIVE JET

This application is a continuation of application Ser. No. 701,460, filed Feb. 14, 1985, now abandoned, which is a continuation of application Ser. No. 436,002, filed Oct. 22, 1982, now abandoned.

FIELD OF THE INVENTION

This invention relates to liquid jets, particularly to abrasive loaded liquid jets, and more particularly to high velocity abrasive liquid cutting jets.

DESCRIPTION OF THE FIELD OF ART

It has long been proposed to accelerate abrasive particles with a jet of high velocity fluid. Such jets may be used for cleaning and surface finishing applications. Dry and wet sand blasting are examples of such applications. In all such methods only the surface of the target material is removed and there is no deep penetration. The fluid used in such applications is commonly air or gas.

It has been proposed that a jet of a liquid could be created having entraped abrasive particles that could be used to cut hard materials. Through proper choice of materials and careful design, it has been found possible to produce jets of liquid having velocities as high as 3000 ft/sec. Such jets may be used to cut a wide variety of relatively soft materials. If such a jet could be charged with abrasive particles, it could cut even very hard materials such as steel or glass at a rapid rate. Attempts to produce such a stream have not met with success for several reasons. First, the high velocity abrasive stream is extremely erosive and has caused destruction of nozzles at a rate sufficient to render the process impractical. Second, existing nozzle designs do not allow the particles of abrasive to reach jet speed, or a substantial fraction thereof, resulting in far less than theoretical cutting capacity. Finally, existing nozzles do not produce a coherent stream of abrasive charged particles resulting in insufficient cutting power and a large kerf.

It has been determined that to produce a useful nozzle for abrasive liquid jet cutting, it is necessary to first produce a coherent stream of abrasive loaded liquid, secondly to maximize the velocity of the particles in the stream, and, finally, accomplish the first two requirements with minimal nozzle wear.

SUMMARY OF THE INVENTION

The invention provides a method and apparatus for producing high velocity, abrasive loaded, coherent streams of liquid. The invention maximizes abrasive particle exit velocity and reduces nozzle wear to provide a long service life.

The method of the invention first forms a stream of high velocity liquid. The stream is directed through a chamber where abrasive particles of low velocity and random direction are added. Air flow in the chamber directs the particles into the entry of the mixing tube where they randomly impact the high velocity water jet. The result is a mixture of high velocity liquid and particles of abrasive having random direction and velocity. This mixture then continues into a reorientation zone where the particles of abrasive are allowed to orient their direction to that of the liquid. This results in a stream of liquid having abrasive particles entraped at its core region. This stream is allowed to continue motion in a nozzle until the particles are accelerated to a velocity approaching that of the liquid. Finally, the stream of liquid and rapidly moving particles exit the nozzle.

The apparatus of the invention includes a nozzle having zones of curvature and profile necessary to accomplish the method. The entry zone is a converging conical section that may be produced by the action of the particles themselves. A change in outline forms the beginning of the reorientation zone. An accelerator zone follows which may be a straight section.

DESCRIPTION OF THE PREFERRED EMBODIMENT

Figure 1:
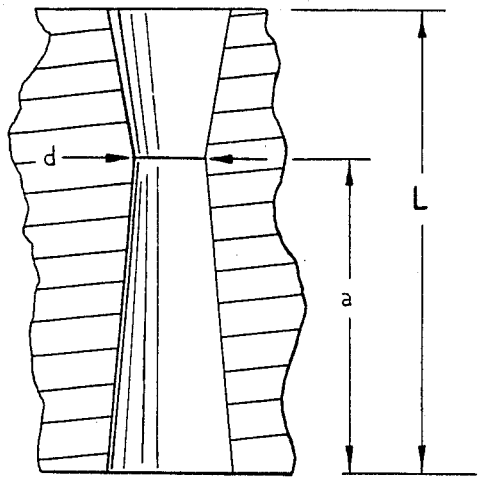
FIG. 1 is a section elevation view of a converging-diverging nozzle.
Figure 2:
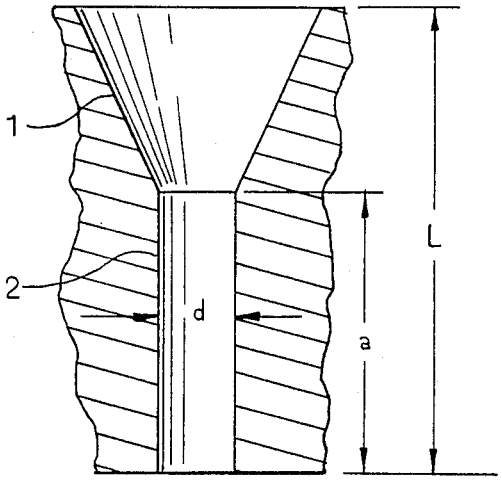
FIG. 2 is a section elevation view of a converging nozzle.

In sand blasting or abrasive jet machining two types of nozzles are in general use. FIG. 1 illustrates the first type of nozzle, a converging-diverging or venturi type nozzle. This type of nozzle has been found unsuitable for use in high velocity abrasive water jet cutting due to extreme nozzle erosion problems. A second type of nozzle illustrated in FIG. 2 has shown somewhat more promise. This nozzle called a straight nozzle including a converging section 1 and a straight section 2 having a length (a) and a diameter (d). The sum of the length of straight section 2 and converging section 1 is the total length (L) of the nozzle. In present nozzles, the ratio of (a)/(d) is less than 20 and is much less for those nozzles where it is between 0.060 and 0.125 inches.

Figure 3:
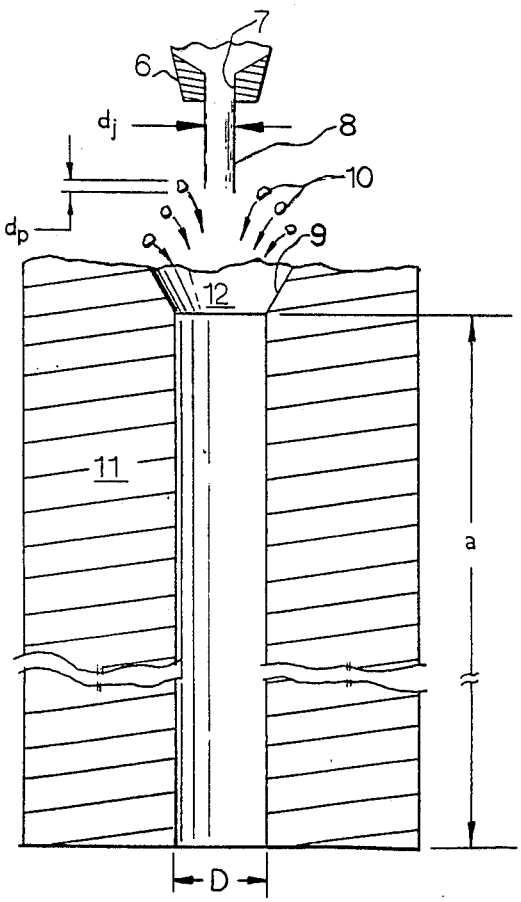
FIG. 3 is a schematic section elevation view of a high velocity water jet cutting system incorporating the invention.

FIG. 3 shows a typical arrangement of components used in abrasive water jet cutting. The drawing is broken for clarity. A high pressure water jet nozzle having an orifice 7 of diameter (dn) receives high pressure liquid having a pressure (P) from a source (not shown) of high pressure liquid which may be a hydraulic intensifier or equivalent. A jet 8 emerges from orifice 7 and enters the convergent section 9 of a nozzle 11. Convergent section 9 of nozzle 11 is also connected to a source (not shown) of abrasive particles 10 having a predetermined size (dp) and a flow rate (m). The entrance of jet 8 into converging section 9 of nozzle 11 creates an area of low pressure 12 at the entrance to nozzle 11. The materials used and the geometry of the apparatus must be adapted to the parameters defined above to produce a satisfactory nozzle.

Figure 4:
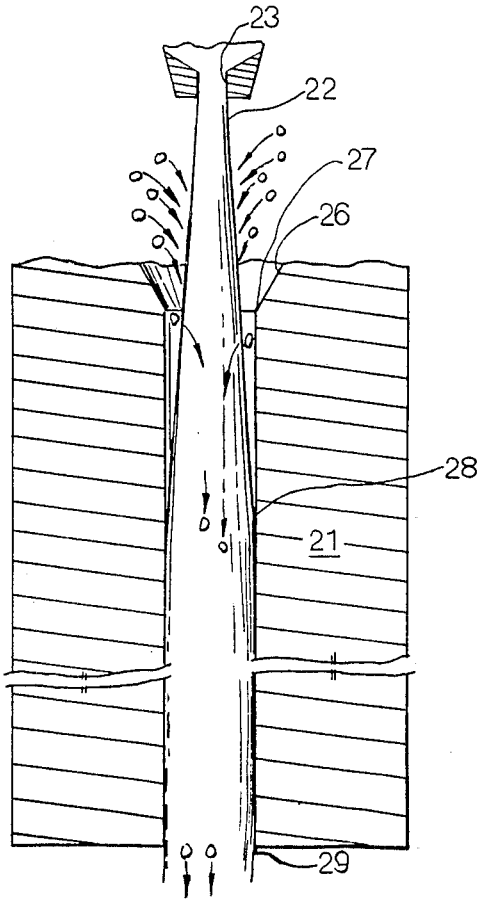
FIG. 4 is a schematic section elevation view of a high velocity water jet cutting system incorporating the invention.

FIG. 4 illustrates the characteristics of fluid flow in a high pressure fluid jet nozzle 21. The drawing is broken for clarity. A jet 22 of high pressure fluid exits from an orifice 23. Typical orifice diameters are from 0.001 to 0.050 of an inch with operating pressures from 5,000 to 100,000 psi or above. This is a jet similar to that used in water jet cutting and orifice 23 is typically synthetic sapphire. It will be noted that jet 22 is slightly divergent when it issues from orifice 23. Abrasive particles are introduced into the entry 26 of nozzle 21. The abrasive particles will typically have a random distribution of direction and velocity, but it is desirable to minimize the turbulence and try to direct toward exit point 29. As jet 22 enters nozzle 21 an area of low pressure will be created in the convergent area of nozzle 21 between points 26 and 27. The reduced pressure in this area causes abrasive particles to be entrained into jet 22. The direction and velocity of the abrasive particles between points 27 and 28 in nozzle 21 still retains a random component and if jet 22 were allowed to exit at point 27 the cutting efficiency would be low. Between points 27 and 28 in nozzle 21 the direction of the abrasive particles is oriented by jet 22 to assure a predominant axial velocity, i.e., toward point 29 and the randomness of direction is removed. The abrasive particles are still moving such slower than jet 22, however, as time is required to transfer momentum from the relatively light liquid to the denser particles of abrasive. Accordingly, a section of nozzle 21 from point 28 to point 29 must be provided. The length of the section between point 28 and 29 must be sufficient so that the velocity of the particles entrained approaches that of jet 22 by point 29. If nozzle 21 is lengthened beyond point 29, frictional losses will occur resulting in deceleration of abrasive particle velocity and loss of cutting power. Prior nozzle designs have attempted to mix and accelerate the particles with the water in the region between 23 and 26 and have allowed exit of the jet either before axial orientation has occured or before the abrasive particles have reached the approximate velocity of the liquid jet. It will be noted that at point 28 jet 22 contacts the wall of nozzle 21. Once contact occurs, jet 22 will assume the flow characteristics of a fluid flowing down a tube at high velocity. The fluid will, accordingly, have a relatively low velocity in that area which is in contact with the wall of nozzle due to formation of a boundary layer. Flow velocity will be much higher as it progresses toward the center of the nozzles diameter. This gradient of velocity will cause the abrasive particles to concentrate at the center of jet 22. The formation of a boundary layer of relatively low velocity and lowered abrasive particle population allows a greatly extended nozzle life and can allow fabrication of the area of nozzle 21 between points 28 and 29 of relatively inexpensive material. Prior designs have allowed the jet to exit before concentration of particles in the center of the jet and have experienced high wear rates.

Due to the complications of mixed phase high velocity flow in and outside of walls, it has not yet been found possible to determine a general equation that allows design of a nozzle that fits the above requirements. Ranges can be defined however for the above parameters which will produce satsifactory nozzles. First, nozzle 22 must be sufficiently long for the abrasives to accelerate to at least 80% of the speed of jet 22 and to have a direction nearly parallel to the tube wall in order to provide a coherent and nearly parallel, cohesive, abrasive jet at point 29. Second, the diameter of the section between points 27 and 29 should be sufficiently small so that the abrasive particles are forced to remain in contact with the liquid, but large enough to pass the abrasives and the liquid. Tubes as small as 0.06 inches have been made to run in 0.03 inch jets and 16 mesh abrasives. This bore should be straight and the material of the tube should have a knoop hardness over 1000 to reduce wear. To fulfill the above requirements, it has been found that the length of nozzle 22 between points 27 and 29 should be between 25 to 100 times its diameter. The diameter of this section should be at least 1.1 times the diameter of the abrasive particles ($D > 1.1dp$). Finally, the diameter of this section should be between 1.1 and 10 times the diameter of orifice 23 ($10dj > d > 1.1dj$). This requires, for example, a nozzle length between point 27 and 29 of at least 4 inches for an orifice 23 of diameter more than or equal to 35 mils. Similarly, a 2 inch, or larger, tube is needed for a 20 mil or larger orifice 23. For an orifice diameter of 1 mil, the length of the nozzle between points 27 and 29 must be at least 0.5 inches. As stated earlier, the section of nozzle 21 between points 28 and 29 may be made of the material having a knoop hardness over 1000 which includes carbides, ceramics, and similar materials.

The upper section of nozzle 21 between points 26 and 28 should be thick walled so that the abrasive particles can erode the inlet section between points 26 and 27 into a nozzle inlet shape.

Figure 5:
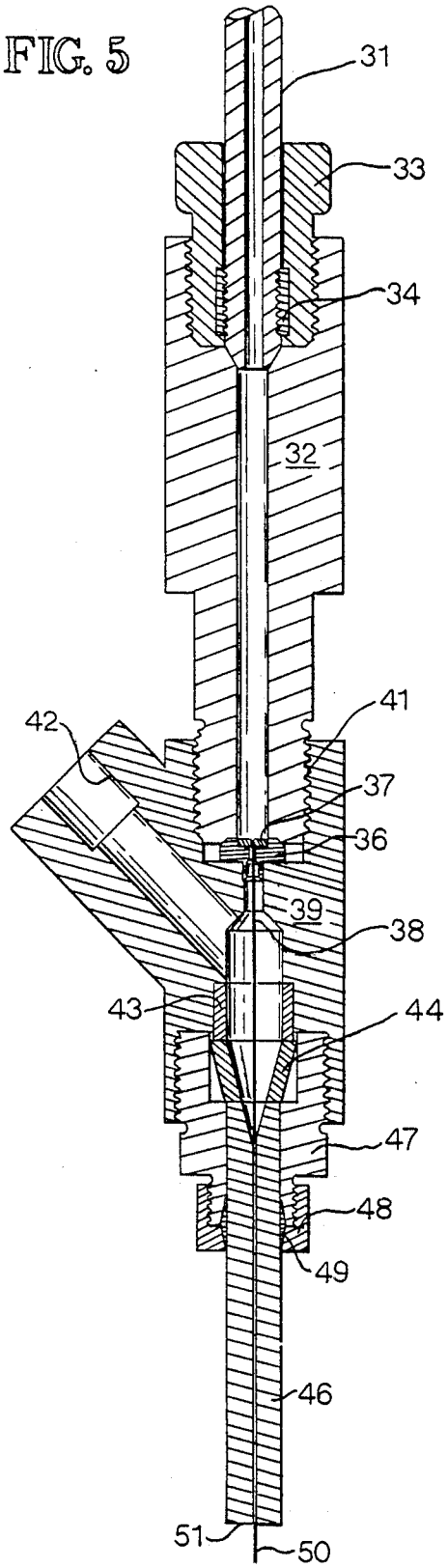
FIG. 5 is a section elevation view of a nozzle assembly incorporating the invention.

FIG. 5 is a section elevation view of a nozzle incorporating the invention. High pressure liquid enters via a supply tube 31 from a high pressure intensifier or equivalent (not shown). Supply tube 31 is attached to the nozzle body 32 by means of a gland 33 and collar 34, although any other connector appropriate for the pressures used could be substituted. The high pressure fluid then flows down the interior of nozzle body 32 which is closed at the end opposite supply tube 31 by a jewel holder 36. Jewel holder 36 seals to nozzle body 32 and includes a recess containing a jewel orifice 37. Jewel orifice 37 is constructed of a hard material such as synthetic sapphire having an orifice diameter of 0.001 to 0.05 inches and is similar to those jewels used in high pressure water jet cutting. The feed water emerges from jewel orifice 37 as a high pressure jet 38 into the interior of the nozzle holder 39. Nozzle holder 39 includes a threaded attachment point 41 for nozzle body 32 and an introduction port 42 for particles of abrasive. The particles of abrasive flow down a line (not shown) attached to port 42 from a storage tank (not shown). Jet 38 and the abrasive particles then pass a collar 43 in the interior of nozzle holder 39. Collar 43 prevents erosive wear of nozzle holder 39. The particles of abrasive and jet 38 then enter a tapered sleeve 44 before entering a nozzle 46. Nozzle 46 is constructed of carbide, or hard material, and is 2 to 8 inches long with a 0.03 to 0.150 inner diameter and 0.363 outer diameter. Nozzle 46 is attached to a steel adapter 47 by a compression fitting nut 48 and compression fitting sleeve 49. Adapter 47 is threadably connected to nozzle holder 39, although equivalent attachment means could be used. Collar 43, tapered sleeve 44 and the upper portion of nozzle 46 form the mixing chamber of the device. The abrasive loaded stream 50 of liquid finally emerges at the end 51 of nozzle 46 and may be used for cutting such hard materials as steel or glass.

Figure 6:
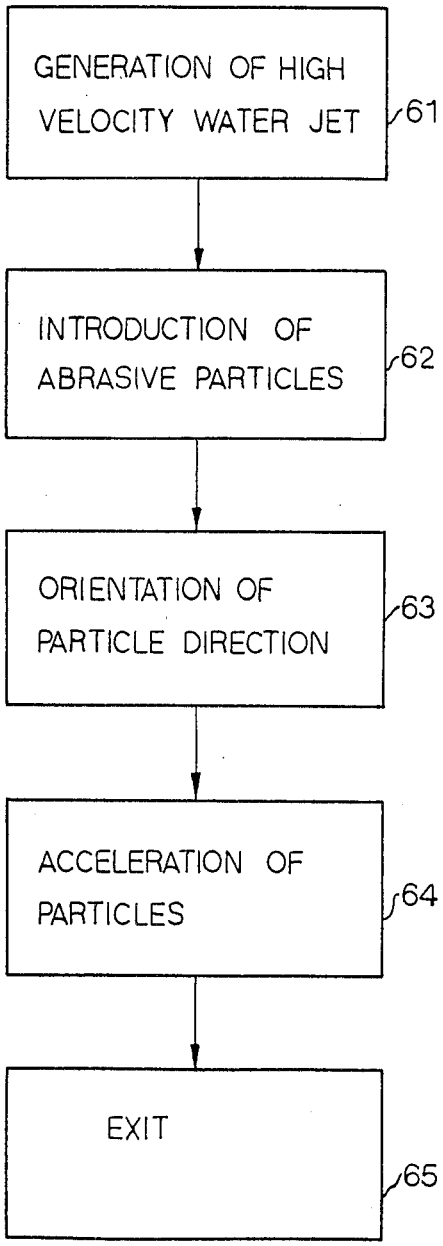
FIG. 6 is a block diagram of the method of the invention.

FIG. 6 is a block diagram of the method of the invention. First a high velocity water jet is generated 61. This may be done much as is presently done in water jet cutting. Abrasive particles are then introduced with the stream 62 into an orienting tube. The particles are then oriented 63 into the direction of the stream. Time is next allowed for acceleration of the particles 64 to a sizeable fraction of stream velocity. The acceleration is accomplished by forcing the stream into an additional length to assume a pipe flow where a boundary layer of fluid having reduced velocity causes concentration of particles in the center of the jet. Finally, the jet charged with particles exits 65 to do work.

Although the present invention has been described with reference to the particular embodiments thereof, it will be understood by those skilled in the art that modifications may be made without departing from the scope of the invention. Accordingly, all modifications and equivalents which are properly within the scope of the appended claims are included in the present invention.

What is claimed is:

1. A method for producing an abrasive laden jet of high velocity liquid within a pressure range of about 5000–100,000 p.s.i. at the output of a jet producing apparatus, said method comprising the steps of:

generating a jet of high velocity liquid; and introducing particles of abrasive into said jet; and, orienting said particles velocity vector to that of said jet; and accelerating said particles through a nozzle arrangement having a downstream-most continuous straight walled cylindrical passageway section which defines an outlet end serving as said output to a speed of at least about 80% of that of said jet as the jet exits the apparatus output and imparting to said particles a component of movement toward the center of said jet sufficient to concentrate said particles at the jet's center as the jet exits said apparatus output, said straight walled passageway section of said nozzle arrangement having a length which is between about 25 and 100 times it's diameter so as to impart said speed to said particles and concentrate them in the center of the jet.

2. A method as in claim 1 wherein said concentrating is accomplished by the step of allowing said jet to contact a wall to produce a velocity gradient providing an area of reduced velocity in the area of said wall.

3. A method as in claim 1 wherein said orienting is accomplished by the steps of:

introducing said jet with abrasive particles into a converging section of a nozzle; and allowing said particles to assume the vector velocity of said jet in said nozzle.

4. A method as in claim 1, wherein said acceleration is accomplished by the steps of:

introducing said oriented abrasive laden stream into a straight section of a nozzle; and allowing said particles to accelerate to a speed approaching that of said jet before exiting said nozzle.

5. An apparatus for producing a jet of abrasive liquid at its output, comprising:

jet means for producing a jet of high velocity fluid and within a pressure range of between about 5000 and 100,000 p.s.i.; and, inlet means for introducing particles of abrasive; and, mixing means attached to said jet means and said inlet means for mixing said jet of high velocity fluid and said particles of abrasive; and, orientation means connected to said mixing means for orienting the velocity vectors of said particles of abrasive; and acceleration means connected to said orienting means including a nozzle arrangement having a downstream-most continuous straight walled cylindrical passageway section which defines an outlet end serving as said output for accelerating said particles of abrasive to a velocity of at least about 80% of that of said jet of high velocity fluid as the jet exits said output and for imparting to said particles a component of movement toward the center of said jet sufficient to concentrate said particles at the jet's center as the jet exits said output said straight walled passageway section having a length which is between about 25 and 100 times it's diameter.

6. An apparatus as in claim 5 wherein the diameter of said straight section is at least 1.1 times the diameter of said jet of high velocity fluid.

7. An apparatus as in claim 6 wherein the diameter of said straight section is between 1.1 and 10 times the diameter of said jet of high velocity fluid.

8. An apparatus as in claim 5 wherein the diameter of said straight section is at least 1.1 times the diameter of the largest of said particles.

9. A method as in claim 1 wherein said generating step is further comprising the steps of;

producing a body of high pressure fluid; and, passing said fluid through at least one orifice less than 0.05 inches in diameter.

10. An apparatus as in claim 5 wherein said jet means includes a jewel orifice for producing a narrow jet of high velocity fluid.

11. The apparatus as in claim 5 wherein said straight section is adapted for contact with a jet of fluid directed along the center line of said straight section.

12. A method as in claim 1 wherein said particle velocity is 80% of said jet's velocity.

13. A method as in claim 1 wherein said stream of liquid and particles emerge as a coherent jet of small diameter.

14. A method of producing a particle laden jet of high velocity liquid within a pressure range of about 5000–100,000 p.s.i. in which the particles within the jet are concentrated at its center, said method comprising the steps of:

(a) providing a nozzle arrangement having a straight passageway which is defined by an axially extending interior wall of the arrangement and which extends from an upstream inlet end to a downstream outlet end, said passageway including (i) a first, converging section which includes said inlet end, and (ii) a second, continuous straight walled cylindrical section which extends from said converging section to and includes said outlet end;

(b) at a specific point coaxial with and upstream of the inlet end of said passageway, forming a diverging jet of high velocity liquid having an initial cross section which is smaller than the cross section of said straight walled passageway section;

(c) introducing particles into said diverging jet upstream of the inlet end of said passageway;

(d) directing said particle laden jet coaxially into said passageway from its inlet end such that the jet first impinges said interior wall within the straight walled section of said passageway at a point downstream from said converging passageway section and thereafter fills the entire cross section of said straight walled passageway section so as to form a boundary layer along said wall which, in turn, forms a cross sectional flow velocity gradient that is at a minimum at said wall and progressively increases toward the center of the passageway so as to impart to said particles within the jet a component of movement toward the center of the jet; and (e) selecting the length of the straight walled section of said passageway so that by the time the jet exits the passageway at said outlet end, the particles have a velocity of at least about 80% of the liquid forming the jet and are concentrated in its center, said straight walled section of said passageway having a length which is between about 25 and 100 times it's diameter.

15. A method of producing a particle laden jet of high velocity liquid within a pressure range of about 5000–100,000 p.s.i., comprising the steps of:

(a) providing a nozzle arrangement having a straight passageway which is defined by an axially extending interior wall of the arrangement and which extends from an upstream inlet end to a downstream outlet end, said passageway including
  (i) a first, converging section which includes said inlet end, and
  (ii) a second, continuous straight walled cylindrical section which extends from said converging section to and includes said outlet end;

(b) at a specific point coaxial with and upstream of the inlet end of said passageway, forming a diverging jet of high velocity liquid having an initial cross section which is smaller than the cross section of said straight walled passageway section;

(c) introducing particles into said diverging jet upstream of the inlet end of said passageway;

(d) directing said particle laden jet coaxially into said passageway from its inlet end such that the jet first impinges said interior wall within the passageway at a point downstream from said converging passageway section and thereafter fills the entire cross section of the passageway section so as to impart to said particles a component of movement toward the center of said jet before exiting said outlet end; and (e) selecting the length of the downstream second section of said passageway so that by the time the jet exits the passageway at said outlet end, the particles within the jet are concentrated in its center, said second section having a length which is between about 25 and 100 times it's diameter.

16. A method according to claim 15 including the step of selecting the length of the downstream section of said passageway so that by the time the jet exits the passageway at said outlet end, the particles have a velocity of at least 80% of the liquid forming the jet.

17. A method of producing a particle laden jet of high velocity liquid within a pressure range of about 5000–100,000 p.s.i. and in which the particles within the jet are concentrated at its center, said method comprising the steps of:

(a) providing a nozzle arrangement having a straight passageway which is defined by a continuous, axially extending cylindrical interior wall of the arrangement and which extends from an upstream inlet end to a downstream outlet end;

(b) at a specific point coaxial with and upstream of the inlet end of said passageway, forming a diverging jet of high velocity liquid;

(c) introducing particles into said diverging jet at a point between the formation of said jet and the inlet end of said passageway;

(d) directing said particle laden jet coaxially into said passageway from its inlet end such that the jet first impinges the interior wall of the passageway at a predetermined point downstream from its inlet end and thereafter fills the entire cross section of the passageway as the jet moves through the latter to its outlet end so as to impart to said particles a component of movement toward the (e) selecting the length of said passageway so that by the time the jet exits the passageway at said outlet end, the particles therein have a velocity of at least 80% of the liquid forming the jet and are concentrated at its center the length of said passageway being between about 25 and 100 times it's diameter.

18. A method according to claim 17 wherein said jet, upon impingement with the interior wall of said passageway and filing its entire cross section, forms a boundary layer along said wall which, in turn forms a cross sectional flow velocity gradient that is at a minimum at said wall and that progressively increases toward the center of the passageway so as to impart to the particles a component of movement toward the center of the jet.

19. A method according to claim 17 wherein said passageway at least includes a straight walled section and wherein said jet first impinges said interior wall within said straight walled section.

20. A method according to claim 19 wherein said passageway includes a converging section upstream of said straight walled section.

21. An apparatus for producing at its output end a particle laden jet of high velocity liquid within a pressure range of about 5000–100,000 p.s.i. and in which the particles within the jet are concentrated at its center as the jet exits said output end, said apparatus comprising:

(a) a nozzle arrangement having a straight passageway which is defined by an axially extending interior wall of the arrangement and which extends from an upstream inlet end to said outlet end downstream from said inlet end, said passageway including
  (i) a first, converging section which includes said inlet end, and
  (ii) a second, continuous straight walled cylindrical section which extends from said converging section to and includes said outlet end;

(b) means located at a specific point upstream of the inlet end of said passageway for forming a diverging jet of high velocity liquid having an initial cross section which is smaller than the cross section of said straight walled passageway section;

(c) means for introducing particles into said diverging jet upstream of the inlet end of said passageway;

(d) said jet forming means being positioned such that said particle laden jet enters coaxially into said passageway from its inlet end such that the jet first impinges said interior wall within the straight walled section of said passageway at a point downstream from said converging passageway section and thereafter fills the entire cross section of said straight walled passageway section so as to form a boundary layer along said wall which, in turn, forms a cross sectional flow velocity gradient that is at a minimum at said wall and progressively increases toward the center of the passageway so as to impart to said particles within the jet a component of movement toward the center of the jet; and (e) the length of the straight walled section of said passageway being such that, by the time the jet exits the passageway at said outlet end, the particles have a velocity of at least about 80% of the liquid forming the jet and are concentrated in its center, said length of said straight walled section being between about 25 and 100 times it's diameter.

22. An apparatus for producing a particle laden jet of high velocity liquid within a pressure range of about 5000–100,000 p.s.i. and in which the particles within the jet are concentrated at its center, said apparatus comprising:

(a) a nozzle arrangement having a continuous straight cylindrical passageway which is defined by an axially extending interior wall of the arrangement and which extends from an upstream inlet end to a downstream outlet end;

(b) means positioned at a specific point coaxial with and upstream of the inlet end of said passageway for forming a diverging jet of high velocity liquid;

(c) means for introducing particles into said diverging jet at a point between the formation of said jet and the inlet end of said passageway;

(d) said jet forming means being positioned such that said particle laden jet is directed coaxially into said passageway from its inlet end so that the jet first impinges the interior wall of the passageway at a predetermined point downstream from its inlet end and thereafter fills the entire cross section of the passageway as the jet moves through the latter to its outlet end so as to impart to said particles a component of movement toward the center of the jet; and (e) the length of said passageway being such that, by the time the jet exits the passageway at said output end, the particles therein have a velocity of at least 80% of the liquid forming the jet and are concentrated at its center, said length of said passageway being between about 25 and 100 times it's diameter.

23. An apparatus according to claim 22 wherein said passageway at least includes a straight walled section and wherein said jet first impinges said interior wall within said straight walled section.

24. An apparatus according to claim 22 wherein said passageway includes a converging section upstream of said straight walled section.

* * * * *

UNITED STATES PATENT AND TRADEMARK OFFICE

CERTIFICATE OF CORRECTION

PATENT NO. : 4,648,215

DATED : March 10, 1987

INVENTOR(S) : Hashish, et al.

It is certified that error appears in the above—identified patent and that said Letters Patent is hereby corrected as shown below:

In the claims:

Claim 17 at column 8, line 4, after "the" add --center of the jet; and--

Claim 18 at column 8, line 13, "filing" should read --filling--.

Signed and Sealed this

Twenty-second Day of March, 1988

*Attest:*

DONALD J. QUIGG

*Attesting Officer*

*Commissioner of Patents and Trademarks*